US005135633A

United States Patent [19]

Kotowski et al.

[11] Patent Number: 5,135,633

[45] Date of Patent: Aug. 4, 1992

[54] ELECTRODE ARRANGEMENT FOR ELECTROLYTIC PROCESSES

[75] Inventors: Stefan Kotowski, Seligenstadt; Rüdiger Weinhardt, Rodenbach; Gerhardt Dehm; Reinhard Koch, both of Freigericht, Fed. Rep. of Germany

[73] Assignee: Heraeus Elektroden GmbH, Hanau am Main, Fed. Rep. of Germany

[21] Appl. No.: 616,367

[22] Filed: Nov. 21, 1990

[30] Foreign Application Priority Data

Dec. 4, 1989 [DE] Fed. Rep. of Germany ..... 3940044

[51] Int. Cl.[5] ..... C25C 7/02

[52] U.S. Cl. ..... 204/286; 204/280; 204/290 F

[58] Field of Search ..... 204/279, 280, 286, 289, 204/290 R, 290 F, 288, 286

[56] References Cited

U.S. PATENT DOCUMENTS

| | | | |
|---|---|---|---|
| 3,970,539 | 7/1976 | Collins | 204/286 |
| 4,022,679 | 5/1977 | Koziol | 204/286 |
| 4,121,994 | 10/1978 | Crippen | 204/286 |
| 4,149,956 | 4/1979 | Bess, Sr. | 204/289 |

FOREIGN PATENT DOCUMENTS 2194963 3/1988 United Kingdom .

OTHER PUBLICATIONS

Patent Abstracts of Japan, vol. 13, No. 457 (C-644) [3805], Oct. 16, 1989 and JP-A-1 176100 (NKK Corp.) Jul. 12, 1989.

*Primary Examiner*—John Niebling
*Assistant Examiner*—Kathryn Gorgos
*Attorney, Agent, or Firm*—Frishauf, Holtz, Goodman & Woodward

[57] ABSTRACT

An anode arrangement used in electrolytic processes for steel strip galvanizing or chrome-plating has a plate-like anode of titanium with an active surface, which is connected to a generally planar carrier having a steel core and a current supply conductor comprising a sleeve element and a bushing element. The core has a passage extending through it to receive the bushing element, and, for protection against attack by the electrolytic solution, the core is loosely surrounded by an envelope of titanium foil; in the region of the bushing element, the envelope has passages, the edges of which are welded to the bushing element in a gas-tight and fluid-tight manner.

10 Claims, 3 Drawing Sheets

ELECTRODE ARRANGEMENT FOR ELECTROLYTIC PROCESSES

The invention relates to an anode arrangement having a plate-like anode of valve metal with an active surface for electrolytic processes, in particular for the recovery of metal from metal-ion-containing solution for deposit on a substrate connected to a current supply conductor of valve metal.

BACKGROUND

In electrolytic processes, such as chlor-alkali electrolysis, or electrolytic galvanizing or chrome-plating of steel bands, strong currents of up to 18,000 A/m$^2$ must be distributed uniformly over large electrode surfaces (up to 4 m$^2$ in steel band galvanizing and up to 36 m$^2$ in the chlor-alkali industry). In steel band galvanizing, the electrode surfaces are segmented titanium plates; the chlor-alkali industry uses expanded-metal wire screens or flat profiles, which are likewise segmented.

The current is fed into the electrolysis cell from outside via metals having good conductivity, such as copper, aluminum or steel; for this purpose, contact must be established between these highly conductive metals and the material of the anode, which as a rule is of titanium.

Since with anodic polarization, copper, aluminum or steel readily dissolves in the electrolytes typically used in industry, it is surrounded by a titanium protective sleeve that is tightly secured to the actual electrode body and carries the current supply conductor to the outside.

Such an arrangement is described in British patent 2,194,963. Here a titanium anode having a copper current feeder stud is connected via a titanium connection element that surrounds the lower end of the stud in sleeve-like fashion; the actual fixation between the current feeder stud and the sleeve-like connection element is achieved by means of a cast metal core.

THE INVENTION

The object of the invention is to assure an economical and functionally reliable current supply to an anode, using a material that is not resistant to the electrolyte yet has good electrical conductivity for the anode carrier.

This object is attained by the provisions of the invention as described hereinafter.

In a preferred embodiment, steel is used as the material for the core of the carrier, while the envelope surrounding the carrier is of titanium. The envelope is welded at the edge to the bushing element of the current supply conductor. The current supply conductor, assembled from the bushing element and the sleeve-like element, is of titanium or a titanium-based alloy, and the sleeve-like and bushing elements have platinum-coated contact faces that rest on one another in the operating state. The sleeve-like and bushing elements are detachably joined together.

In further preferred embodiments, copper or aluminum can be used as the material for the core of the carrier.

Further advantageous features of the invention are recited in the dependent claims.

It proves to be advantageous to make an economical, secure current connection with the anode, thus making sparing use of valve metal; the loose lining avoids labor-intensive operations, such as explosion plating, which also entail major tolerance problems in the plane of the carrier, since in practice many current supply conductors must be used between the carrier and the anode or anodes; it proves to be highly advantageous that the passages for receiving the bushing elements can be milled directly into the core of the carrier, so that all the bushing elements are located in planar fashion in an ideal plane of low tolerance. On a plate 4 m$^2$ in size and 40 mm thick serving as the core, a tolerance of $\pm 0.5$ mm, in terms of the planar location of the bushing elements in the ideal plane, can be achieved.

Another advantage is that both the supply of current and the mechanical connection between the carrier and the anode are achieved optimally and economically.

The subject of the invention is described in further detail below, referring to the drawings.

DRAWINGS

FIG. 1 is a detail showing a cross section of the anode arrangement, while

FIG. 3 is a cross section of an anode arrangement having a current supply conductor, with a bushing element that can be screwed into the core of the carrier, while

DETAILED DESCRIPTION

Figure 1:
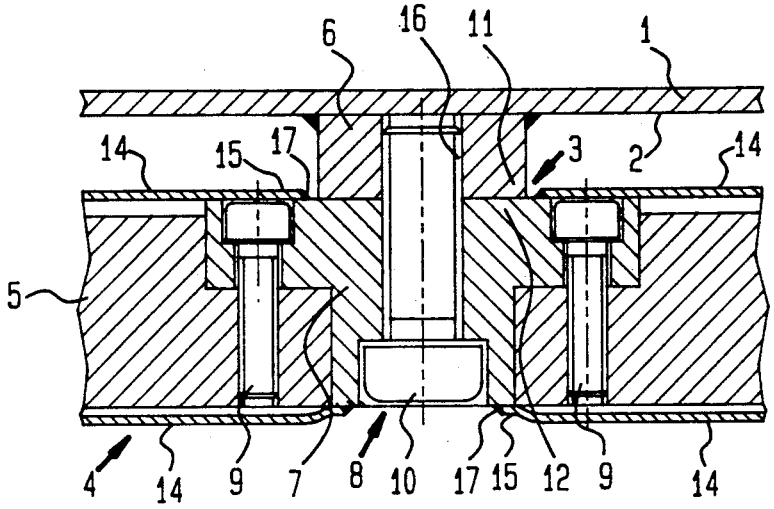
Figure 2:
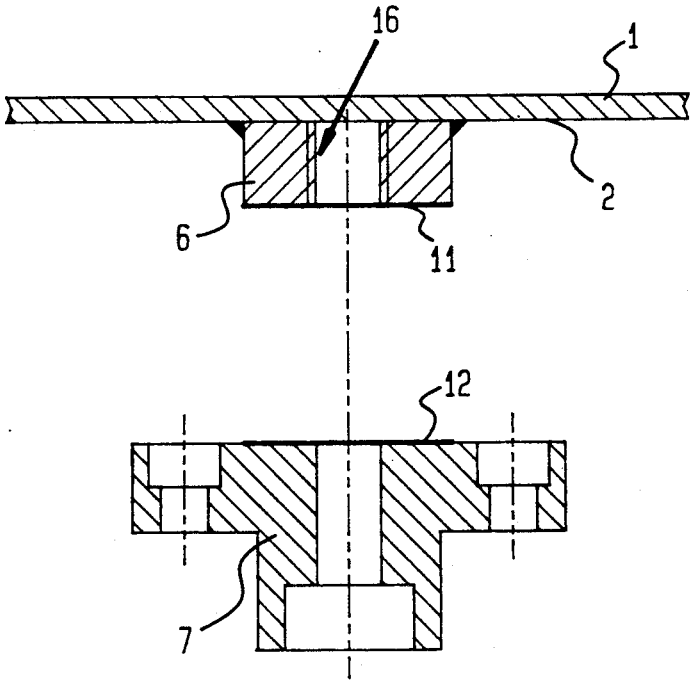
FIG. 2 shows both elements of the current supply conductor.

In FIG. 1, a plate-like anode 1 of titanium, shown in the form of a detail, is connected on its back side 2, via a current supply conductor 3 of titanium, with a carrier 4, likewise shown in the form of a detail, and which includes a plate-like core 5 of steel, which is surrounded by an envelope 14. The current supply conductor 3 comprises a sleeve-like element 6 of titanium, secured to the anode 1 by annular welding, and a bushing element 7, inserted into a passage 8 of the core 5 and joined immovably to the core by fastening with pins 9; in FIG. 1, countersunk screws are used as the pins 9. The sleeve-like element 6 rests with its flat contact face 11, extending parallel to the plate face of the anode 1, on a likewise flat contact face 12 of the bushing element 7; both contact faces 11, 12 have a platinum-plated surface, to prevent crevice corrosion. The platinum-plated surfaces of these two elements 6, 7 of the current supply conductor 3 are shown in further detail in FIG. 2. From that figure it can be seen that the sleeve-like element 6, provided with a central threaded recess 16, is provided on its contact face 11 with a platinum coating, the film thickness of which is approximately 0.5 $\mu$m. The facing contact face 12 of the bushing element 7 is likewise provided with a platinum coating that is 0.5 $\mu$m thick; this bushing element 7 includes a central bore for the passage through it of a fastening element, in the form of a titanium countersunk screw 10, as shown in FIG. 1. The countersunk screw 10, upon being screwed into the threaded recess 16, establishes an immovable sleeve-like connection between the element 6 and the bushing element 7 and thus establishes an immovable connection between the anode 1 and the carrier 4.

The core 5 of the carrier 4, in FIG. 1, is loosely surrounded by an envelope 14 of titanium foil, which in the region of the bushing element 7 has two opposed passages, the edges 15 of which are each connected to the surfaces of the bushing element 7 in a gas-tight and fluid-tight manner by welding. The envelope 14 comprises a titanium film approximately 1 mm thick. The encompassing welds are identified by reference numeral 17.

Figure 3:
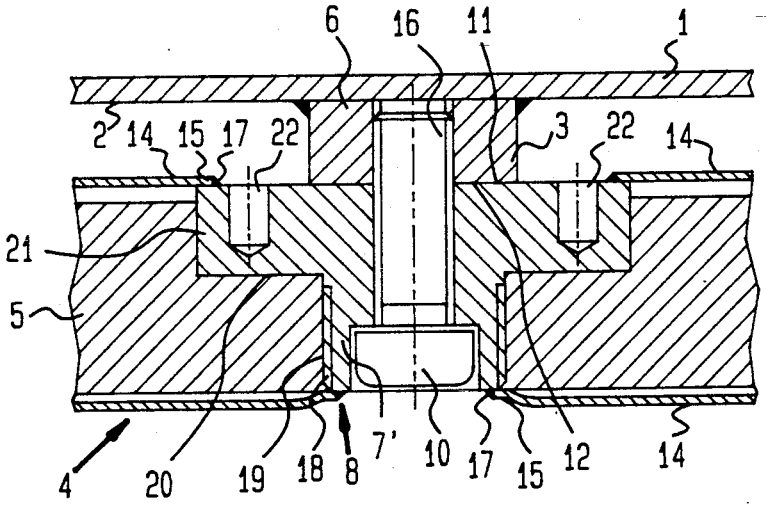

As seen in FIG. 3, it is also possible for the bushing element, here identified by reference numeral 7', to be embodied as an axially symmetrical turned part having a thread 18, which is screwed into a corresponding threaded recess 19 in the core 5 with a stop 20 for the enlarged region 21 of the bushing element 7'. The sleeve-like element 6 is firmly connected to the back side 2 of the anode 1 by an encompassing weld connection. The two contact faces 11, 12 resting on one another are likewise provided with a platinum-plated surface, as described in conjunction with FIGS. 1 and 2. The arrangement shown in this drawing figure enables particularly simple assembly, since the bushing element 7' need merely be screwed into the core 5 until it reaches the stop. To attain optimal contact pressure of the bushing element 7' against the stop 20 in the core 5, the bushing element 7' has indentations 22, into which cams of a gripping tool can be inserted for tightening. The mechanical connection between the two elements 6 and 7' of the current supply conductor 3 is effected — as already explained in conjunction with FIG. 1— by means of a titanium countersunk screw 10, which after the the bushing element 7' is inserted and tightened is introduced and tightly screwed to the threaded recess 16 in the sleeve-like element 6.

Figure 4:
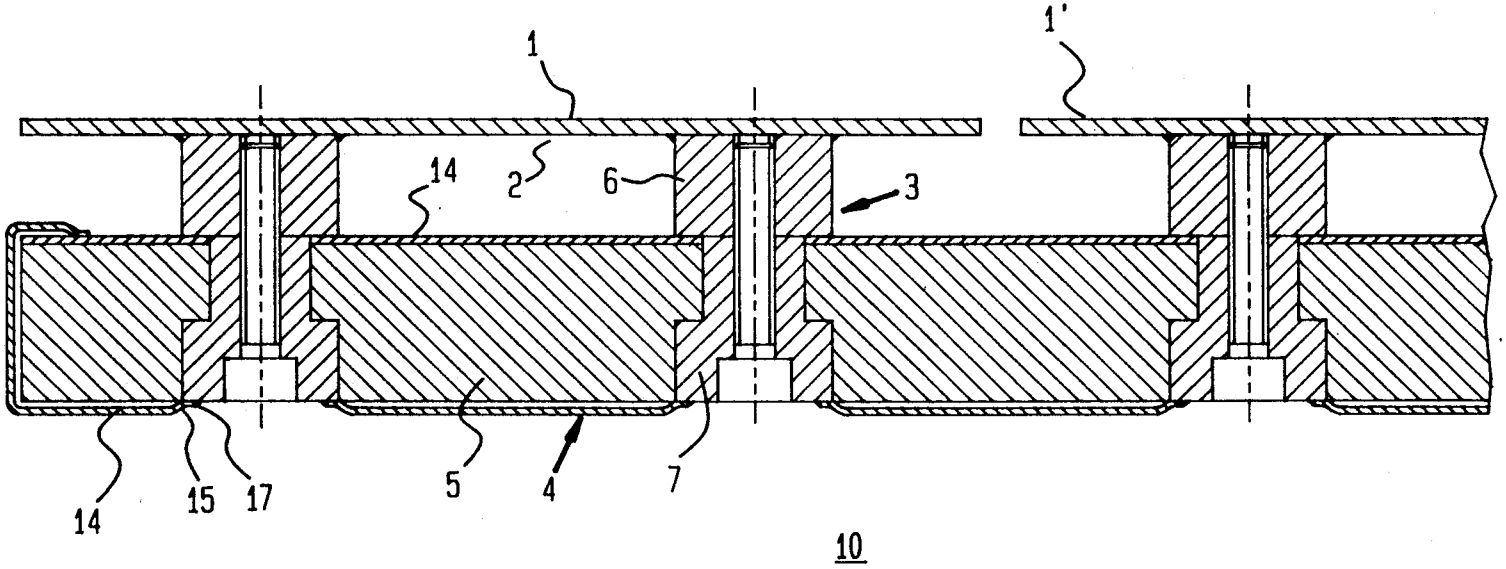
FIG. 4 is a schematic cross-sectional view of an anode arrangement with a plurality of current supply conductors.

FIG. 4 schematically shows a cross section through an anode arrangement, in which the anode 1 is connected to the carrier 4 via a plurality of current supply conductors 3, each comprising the sleeve-like element 6 and the bushing element 7. A plate-like anode 1 of this kind has a basic surface area of 0.2 to 0.4 $m^2$, for example, and a thickness on the order of 2 to 7 mm; it is firmly connected electrically and mechanically to the carrier 4 via a plurality of such current supply conductors. The current supply conductors may for instance be disposed in a plurality of rows parallel to one another. An anode 1' adjacent to the anode 1 is shown in only fragmentary form, to simplify the drawing. The connection of the current supply to the carrier 4 is effected by means of one or more current feed studs made of material with good electrical conductivity, which are likewise provided with a titanium envelope. The thickness of the plate-like carrier 4 is in the range from 20 to 60 mm; it is large enough that the current, fed into the carrier from outside in concentrated form, is distributed uniformly, without significant resistance losses; furthermore, the plate has adequate mechanical strength to support the anode surface area, which as a rule comprises a plurality of anodes.

Various changes and modifications may be made, and features described in connection with any one of the embodiments may be used with any of the others, within the scope of the inventive concept.

We claim:

1. An electrode arrangement for electrolytic processes, especially for the recovery of metal from metal-ion-containing solution where the recovered metal is deposited on a substrate connected to a current supply conductor made of valve metal, comprising a planar anode (1) of valve metal having an active surface;

a carrier (4) spaced from said anode (1) and having a core (5) formed with a passage (8) extending therethrough, perpendicular to said planar anode (1), and a bushing element (7; 7') substantially filling said passage (8); and a current supply conductor (3) supplying current to said anode (1) and including a sleeve element (6) which spaces said anode (1) from said carrier (4);

wherein said sleeve element (6) is secured to the anode (1), said core (5) is of electrolytic-solution-intolerant yet electrically good conducting material, and is loosely surrounded by a relatively thin envelope (14) of valve metal;

said envelope (14) has an edge (15) which is connected to said bushing element (7; 7') in a gas-tight and fluid-tight manner, and said core (5) is immovably connected to said bushing element (7; 7').

2. Electrode arrangement of claim 1, wherein the material of the core (5) is a metal material.

3. Electrode arrangement of claim 2, wherein the metal material of the core (5) is steel.

4. Electrode arrangement of claim 1, wherein the envelope (14) is welded at its edge (15) to the bushing element (7; 7').

5. Electrode arrangement of claim 1, wherein the bushing element (7') is screwed into the passage (8).

6. Electrode arrangement of claim 1, wherein the bushing element (7) is connected to the core (5) by means of pins (9).

7. Electrode arrangement of claim 1, wherein the sleeve-like element (6) and the bushing element (7; 7') are of titanium or a titanium-based alloy.

8. Electrode arrangement of claim 7, wherein said sleeve element and said bushing element each have a respective contact face, which faces contact one another during operation, and said contact faces (11, 12) are platinum-plated.

9. Electrode arrangement of claim 1, wherein the sleeve element (6) and the bushing element (7; 7') are detachably joined together.

10. Electrode arrangement of claim 9, wherein a countersunk screw (10) of titanium is provided for the detachable connection between the sleeve element (6) and the bushing element (7; 7').

* * * * *